US009045251B2

(12) United States Patent
Sanchez et al.

(10) Patent No.: US 9,045,251 B2
(45) Date of Patent: Jun. 2, 2015

(54) CONTAINER WITH REINFORCING LOCKING TABS

(71) Applicants: IP CARTONES y CORRUGADOS, S. de R.L. de C.V., Guanajuato (MX); INTERNATIONAL PAPER COMPANY, Memphis, TN (US)

(72) Inventors: Hector Alonso Sanchez, San Nicolas de los Garza (MX); Jose Manuel Fraga Munoz, Santa Catarina (MX); David Kretz, Los Fresnos, TX (US)

(73) Assignees: IP CARTONES Y CORRUGADOS, S. DE R.L. DE C.V., Guanajuato (MX); INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 14/445,379

(22) Filed: Jul. 29, 2014

(65) Prior Publication Data

US 2015/0034708 A1 Feb. 5, 2015

Related U.S. Application Data

(60) Provisional application No. 61/860,059, filed on Jul. 30, 2013.

(51) Int. Cl.

| | |
|---|---|
| ***B65D 5/28*** | (2006.01) |
| ***B65D 5/44*** | (2006.01) |
| ***B65D 5/00*** | (2006.01) |
| ***B65D 5/468*** | (2006.01) |
| ***B65D 5/66*** | (2006.01) |
| *B65D 5/30* | (2006.01) |

(52) U.S. Cl.

CPC ..... *B65D 5/443* (2013.01); *B65D 5/445* (2013.01); *B65D 5/0025* (2013.01); *B65D 5/308* (2013.01); *B65D 5/4608* (2013.01); *B65D 5/6632* (2013.01); *B65D 5/002* (2013.01)

(58) Field of Classification Search

CPC ..... B65D 5/445

USPC ..... 229/143, 149, 151, 154, 190, 191, 915, 229/918

See application file for complete search history.

(56) References Cited

U.S. PATENT DOCUMENTS

| | | | | |
|---|---|---|---|---|
| 1,981,836 | A * | 11/1934 | Greve | 229/190 |
| 2,665,836 | A * | 1/1954 | Rendall | 229/191 |
| 4,056,223 | A | 11/1977 | Williams | |
| 4,236,740 | A | 12/1980 | Sorenson et al. | |
| 4,319,710 | A | 3/1982 | Osborne | |
| 4,621,766 | A | 11/1986 | McClure | |

(Continued)

FOREIGN PATENT DOCUMENTS

| | | |
|---|---|---|
| WO | WO8605762 | 10/1986 |

*Primary Examiner* — Gary Elkins

(74) *Attorney, Agent, or Firm* — Matthew M. Eslami

(57) ABSTRACT

A container is formed from a one-piece blank including a bottom panel, first and second opposed side walls, and first and second end walls. A top lid panel is foldably attached to the first side wall and a bottom lid panel is foldably attached to the second side wall. A plurality of reinforcing locking tabs is formed in the respective top and bottom lid panels. Each of the respective plurality of reinforcing locking tabs is sandwiched between their respective inner panel and middle panels so as to prevent the side walls from being distorted upon outward pressure applied to these side walls when the container is unreasonably over-packed during shipping and transportation.

2 Claims, 7 Drawing Sheets

(56) References Cited

U.S. PATENT DOCUMENTS

| | | | | |
|---|---|---|---|---|
| 4,770,339 | A * | 9/1988 | Weimer | 229/143 |
| 5,000,377 | A | 3/1991 | McClure | |
| 5,002,224 | A | 3/1991 | Muise | |
| 5,139,195 | A | 8/1992 | McClure | |
| 5,285,956 | A | 2/1994 | Piepho | |
| 5,289,970 | A | 3/1994 | McClure | |
| 5,289,971 | A | 3/1994 | McClure | |
| 5,588,585 | A | 12/1996 | McClure | |
| 5,996,885 | A * | 12/1999 | Chu | 229/191 |
| 6,135,347 | A | 10/2000 | Mueller | |
| 6,367,690 | B1 * | 4/2002 | McClure | 229/143 |
| 6,402,020 | B1 | 6/2002 | McClure | |
| 6,575,356 | B2 | 6/2003 | McClure | |
| 6,595,411 | B2 | 7/2003 | McClure | |
| 8,205,787 | B2 * | 6/2012 | Panduro et al. | 229/143 |
| 2005/0116017 | A1 * | 6/2005 | Nass | 229/143 |

* cited by examiner

CONTAINER WITH REINFORCING LOCKING TABS

CROSS REFERENCE TO RELATED APPLICATIONS

This application claims priority to U.S. provisional patent application Ser. No. 61/860,059, filed on 30 Jul. 2013, which is hereby incorporated hereinto by reference as if fully restated herein.

FIELD OF THE INVENTION

The present invention relates to paperboard containers having doubled-over reinforcing panel sub-assemblies at its interior corners, and in particular, to locking mechanism used in the paperboard container to help maintain and prevent from bulging out even if the container is over-packed.

BACKGROUND OF THE INVENTION

It is well known to form paperboard containers or boxes that use extra wall layers to increase wall thickness at the corners of the container to improve stacking strength. Such containers are typically used with products that are unusually heavy, e.g., frozen meat, paper files, books, canned goods, etc.

Examples of such a container are shown in U.S. Pat. No. 5,000,377, U.S. Pat. No. 6,402,020, U.S. Pat. No. 6,575,356, and U.S. Pat. No. 6,595,411, the disclosure of which is incorporated in full herein by reference. These prior containers use doubled-over reinforcing panel sub-assemblies at its interior corners and optionally glue flaps about its exterior upper surface. Many of these containers are typically formed by machine. However, this can be a problem for small business that cannot afford the huge investment required to install tray formers and case sealers. To date, small manufacturers have had to settle for much more expensive and less efficient box styles than their large competitors. These expensive and less efficient box styles include "swing under" styles, double wall RSC's (regular slotted containers), and various combinations of hand-erected trays and HSC's (half slotted containers), all of which require much more paperboard for a given endurance level.

Therefore, it is desirable to provide a corrugated paperboard container having locking features to help maintain the container from opening when outward pressure was applied at the side walls or when the lid of the container was folded away from the container as the container is filled.

SUMMARY OF THE INVENTION

The present invention reduces the propensity of the previously existing length-panel locks on the container from opening when outward pressure was applied at the side walls or when the lid of the container was folded away from the container as the container is filled with articles. The existing locks on the container may be opened if it is unreasonably over-packed, and thus the container would lose its shape, and essentially return to a knocked-down flat shape. A reinforcing locking tab is added that would prevent the side walls from being deflected outward, thus reducing the propensity of the side wall locks from opening. When these reinforcing locking tabs are in-place, the side walls of the container are held in a vertical position, thus maintaining the integrity of the locks on the container. Furthermore, these reinforcing tabs also reduce length-panel bulge when the container is under load.

Additionally, these reinforcing locking tabs are formed by material which is already contained in the existing blank size of the container. No additional material or increase in blank size or in the basis weight of corrugated material is added to container to gain the aforementioned benefits of the present invention. In accordance with the teaching of the present invention, an efficient and easily hand-formed container is provided from a one-piece corrugated paperboard blank which includes various inventive features such as reinforcing locking tabs and hingedly connected inner, middle, and outer panels that may be used singularly or in combination with other inventive features.

Accordingly, one aspect of the present invention is directed to a container formed from a one-piece blank including a bottom panel, first and second opposed side walls foldably attached to the bottom wall, and first and second end walls foldably attached to the bottom wall. A top lid panel is foldably attached to the first side wall and a bottom lid panel is foldably attached to the second side wall. Each of the respective first and second end walls includes a respective first and second reinforcing panel sub-assembly that are foldably attached to the lateral edges of the end walls. The respective first and second reinforcing panel sub-assembly is defined by an inner panel, a middle panel, and an outer panel. A plurality of reinforcing locking tabs where each of which is formed in the top and bottom lid panels and wherein the respective plurality of reinforcing locking tabs is sandwiched between a respective inner panels and a respective middle panels so as to prevents the side walls from being distorted upon outward pressure applied to these side walls when the container is unreasonably over-packed during shipping and transportation.

Another aspect of the present invention is directed to a container formed from a one-piece blank which comprises a bottom panel having two pairs of opposed side edges. First and second opposed side walls are hingedly connected to one pair of opposed side edges of the bottom panel. A top lid panel is hingedly connected to the first side wall. The top lid panel includes two reinforcing locking tabs (112*a*), (112*b*) spaced apart from one another. A locking tab is formed in the first side wall on at the hinged connection. The locking tab includes a thumb notch located within the tab adjacent to the fold line. The top lid panel includes a pair of cover latches located on the outer corners thereof. A bottom lid panel is hingedly connected to the second side wall. The top lid panel includes two reinforcing locking tabs (112*c*), (112*d*) spaced apart from one another. The bottom lid panel includes a pair of alignment tabs located on the outer corners thereof. First and second opposed end walls are hingedly connected to the other pair of opposed edges of the bottom panel.

Each end wall having opposed side edges is oriented orthogonal to its hinged connection to the bottom panel. Each end wall includes a hand hole lock, a lock slot, and a recess located along an end wall exterior edge. The lock slot is located between the recess and the hand hole lock. Each end wall further includes a first reinforcing panel sub-assembly hingedly connected to one end wall edge and including an inner panel, a middle panel, and an outer panel. The outer panel includes a recess along an outer panel exterior edge and a hand hole. The middle panel includes a locking slot near a middle panel exterior edge. The inner panel includes a pair of recesses with an intermediate tab located along an inner panel exterior edge.

A second reinforcing panel sub-assembly is hingedly connected to the other end wall edge and including an inner panel, a middle panel, and an outer panel. The middle panel includes a locking slot near a middle panel exterior edge. The inner panel includes a pair of recesses and an intermediate tab each located along an inner panel exterior edge. When the one-piece blank assembled, the locking tab is disposed within the lock slot with the intermediate tab of the inner panel inserted into the locking tab thumb notch. The cover latch is inserted into the locking slot of the end panel and the alignment tabs are positioned in the recesses of the outer panel of the first reinforcing panel sub-assembly and the end wall and each of the respective reinforcing locking tabs (112*a*), (112*b*), (112*c*), (112*d*) is sandwiched between the respective inner panels and a respective middle panels so as to prevents the side walls from being distorted upon outward pressure applied to these side walls when the container is unreasonably over-packed during shipping and transportation.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAIL DESCRIPTION OF THE INVENTION

Figure 1:
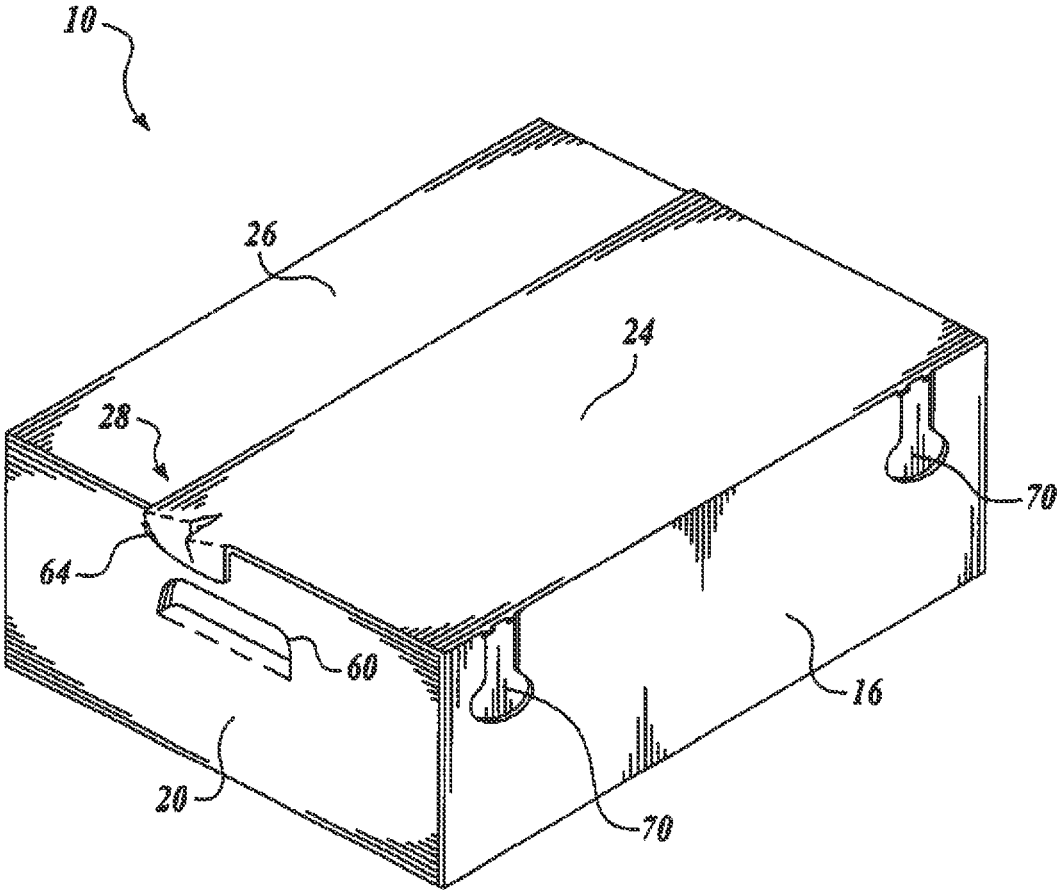
FIG. 1 (PRIOR ART)
FIG. 1 is a perspective view of a prior art container shown in its configuration for shipping.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same.

Figure 2:
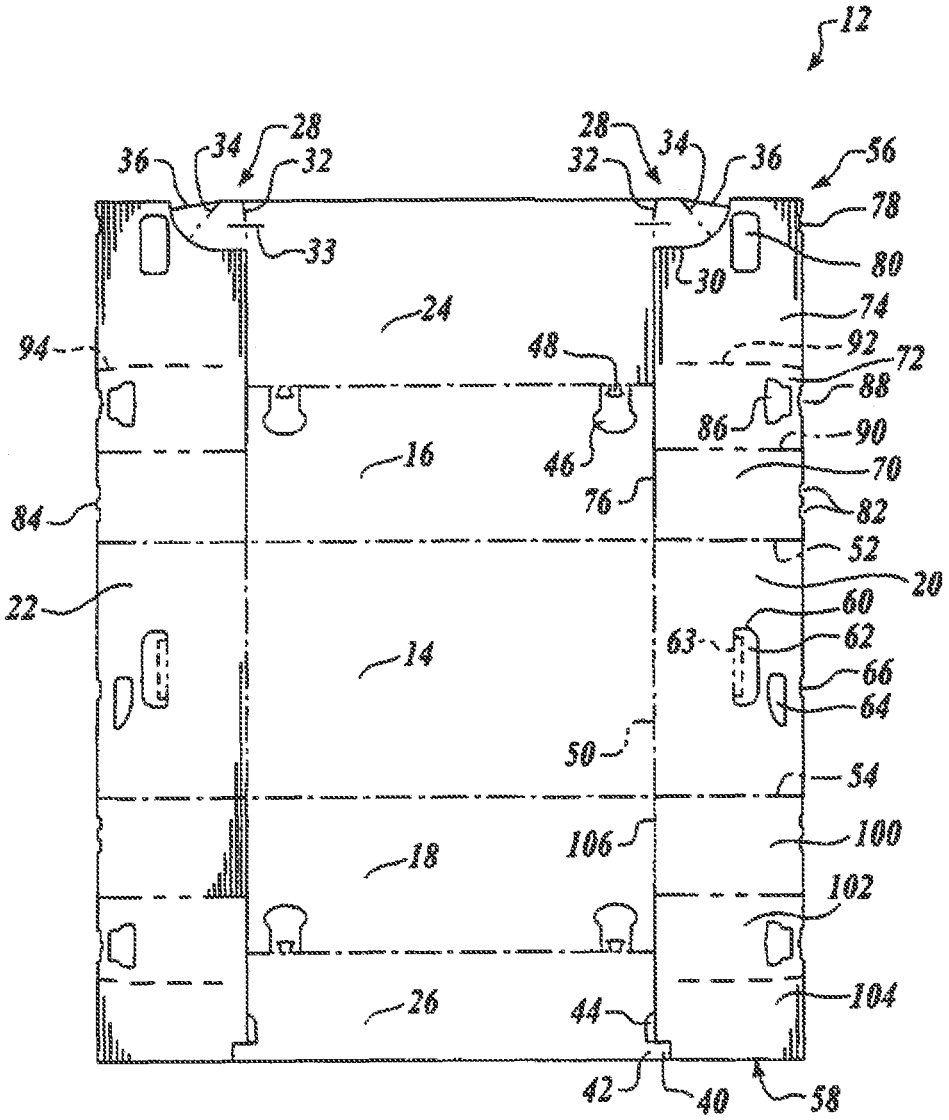
FIG. 2 (PRIOR ART)
FIG. 2 is a plan view of the paperboard blank from which the container of FIG. 1 is formed.
Figure 3:
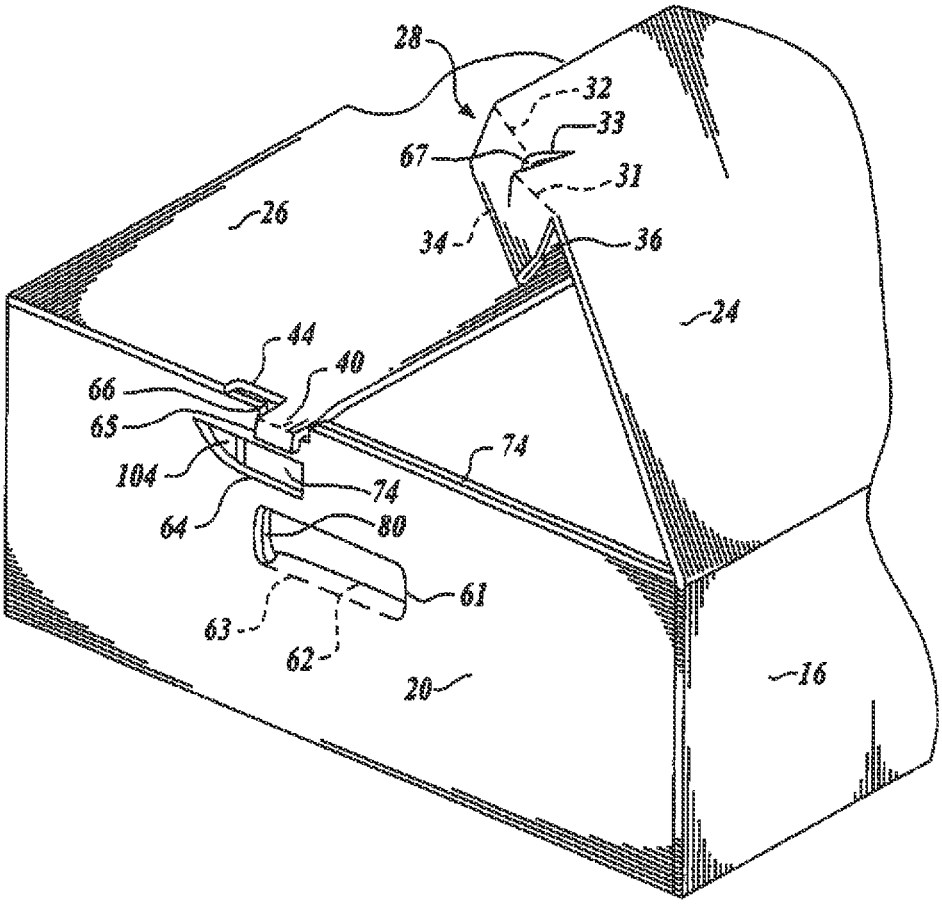
FIG. 3 (PRIOR ART)
FIG. 3 is a fragmentary perspective view of the container in FIG. 1 illustrating an end wall exterior during assembly.
Figure 4:
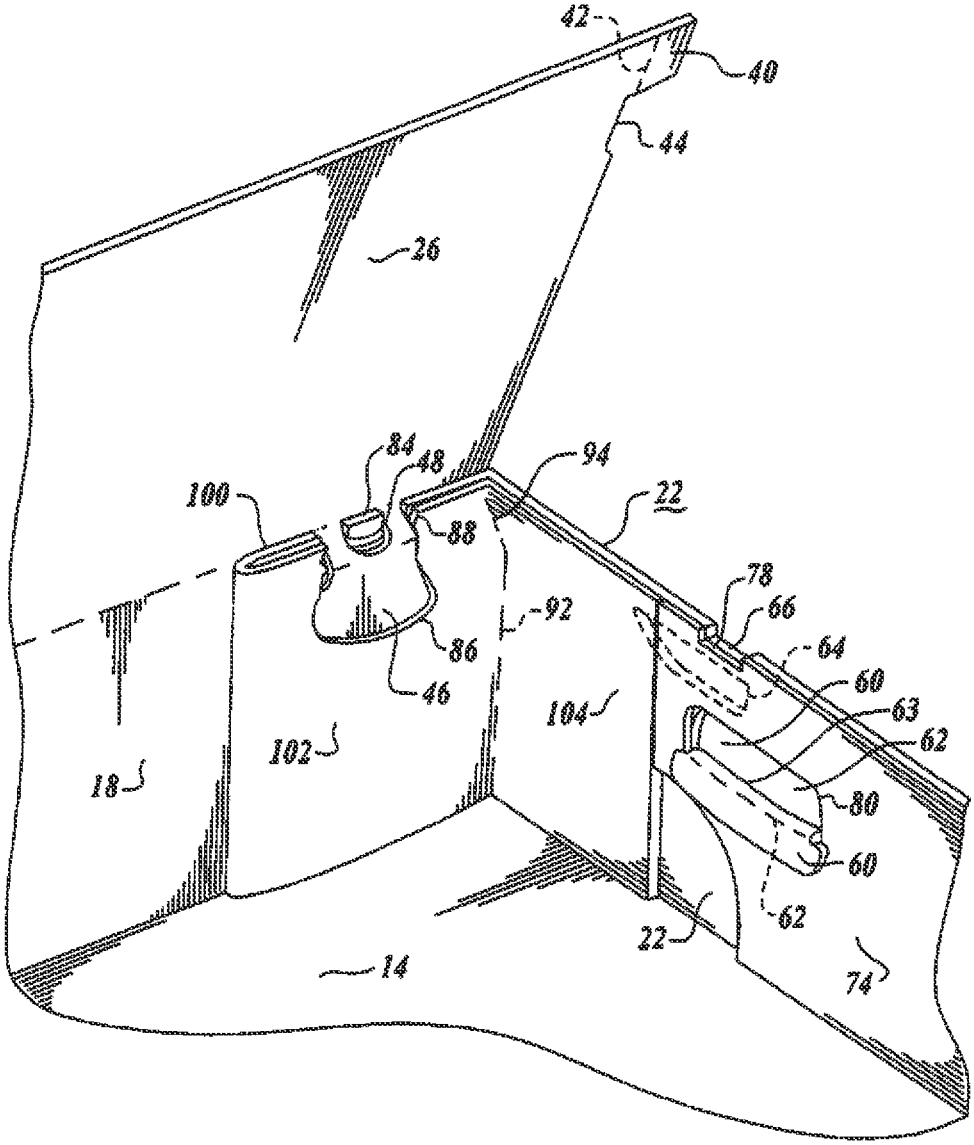
FIG. 4 (PRIOR ART)
FIG. 4 is a fragmentary perspective view of the container in FIG. 1 illustrating an end wall interior during assembly.

Referring to FIGS. 1 and 2, where FIG. 1 is a perspective view of a prior art container 10 shown in its configuration for shipping and FIG. 2 is a plan view of the paperboard blank 12 from which the container 10 of FIG. 1 is formed. The container 10 comprises a bottom panel 14, respective first and second side walls 16 and 18, respective first and second end walls 20 and 22, all of which are foldably attached to one another. Each of the respective top lid panel 24 and bottom lid panel 26 is foldably attached to the respective first side wall 16 and second side wall 18. The top lid panel 24 includes cover latches 28 formed at each outer corner edges. The container 10 includes reinforced corners for improved stacking strength and the additional benefits associated with the various inventive locking mechanisms. The locking tab and lock slot engage one another in a secure manner. However, sometimes the users abuse the container 10 by significantly overpacking the container 10 with products that are heavy, e.g., frozen meat, paper files, books, canned goods, and the like. This unusual overpacking of the container 10 applies tremendous side pressure on the side walls of the container 10 and causes the locking tabs 46 pop open and ultimately the container 10 will not hold its shape. The present invention solve this problem by adding a reinforcing locking tab which is captured between the layers of the already existing double wall corners of the container 10 as described in great detail hereinafter. The detail description of FIGS. 1-4 can be found in U.S. Pat. No. 6,402,020, the disclosure of which is incorporated in full herein by reference and is not repeated again to avoid redundancy.

Figure 5:
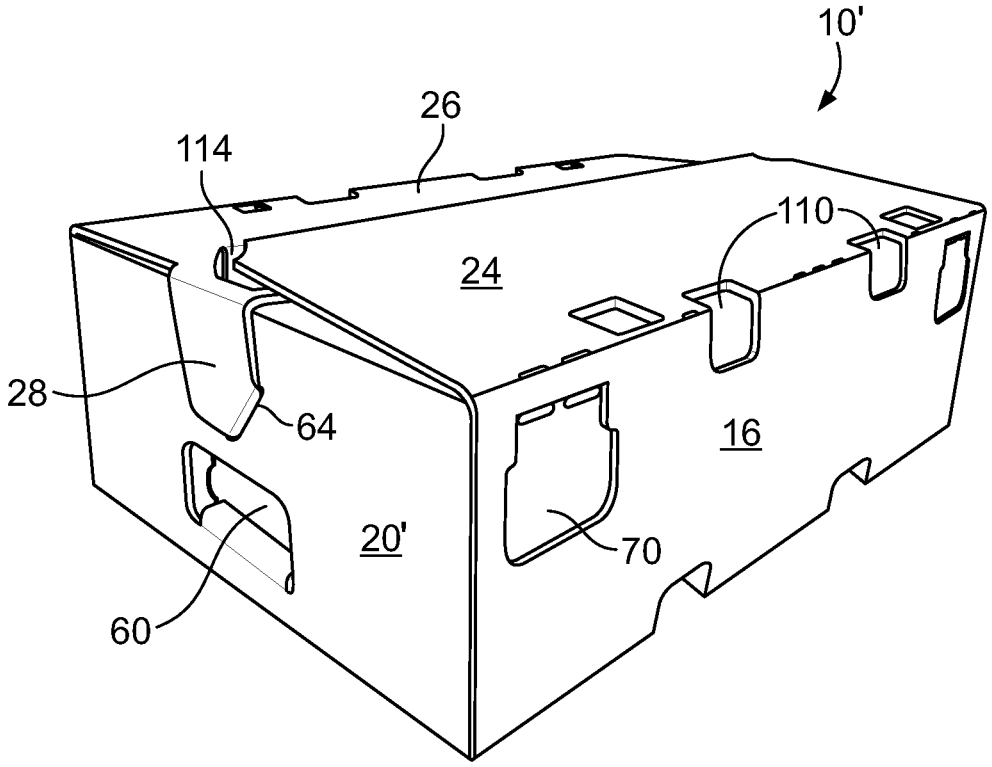
FIG. 5 is a perspective view of a container formed in accordance with a preferred embodiment of the present invention.

FIG. 5 is a top perspective view of a container 10' formed in accordance with a preferred embodiment of the invention. The container 10' comprises a bottom wall 14' having opposite parallel side walls 16', 18' and opposite parallel end walls 20', 22' extend foldably from the edges of the bottom wall 14'. The side walls 16' and 18' extend foldably from longer edges of the bottom wall 14' and the end walls 20', 22' extend foldably from shorter edges of the bottom wall. Two top lid panels 24', 26' each of which foldably extends from respective side wall panels 16', 18' encloses the container 10' in a partially overlapping relationship with respect to one another. However, one of ordinary skill in the art would appreciate that it is within the scope of the present invention to use a single top lid or a cover integrally attached to one of the side walls or end walls of the container 10'. A plurality of vent holes 110 are formed on various sides of the container 10' to facilitate in freezing the products such as beef, poultry and the like. For example, there are total of eight vent holes, four vents on the top side and four vents on the bottom side of the container 10', but any number of vent holes 110 may be formed on the container 10'. Two hand holes openings 60'*a*, 60'*b* are formed on the respective end walls 20', 22' to facilitate handling of the container 10'.

Figures 6A, 6B:
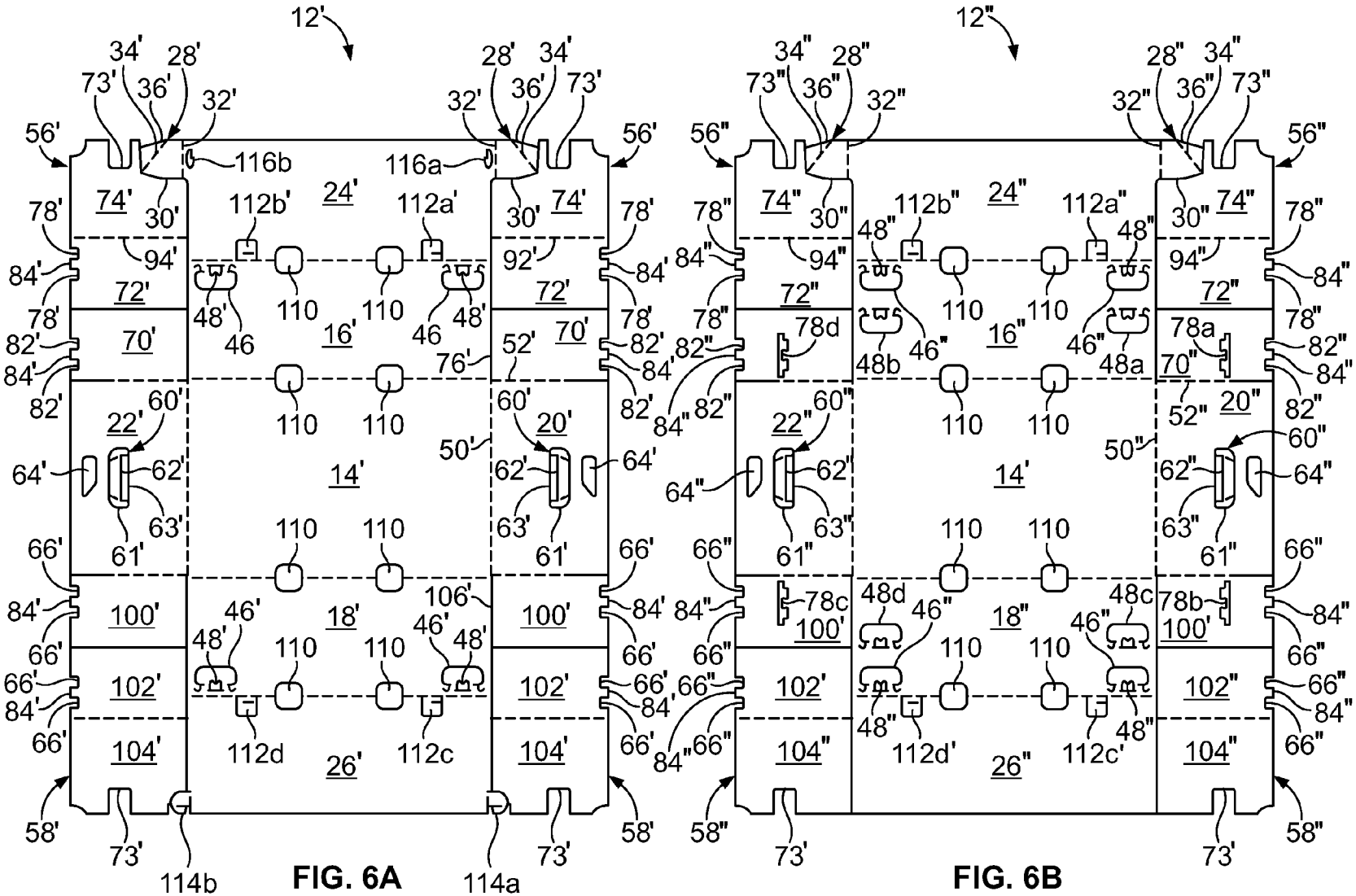
FIG. 6A is a plan view of a unitary blank used to form the container shown in FIG. 5 in accordance with the present invention.
FIG. 6B is a plan view of an alternative unitary blank that is the same as blank in FIG. 6A except that four extra locking tabs and corresponding four recesses are formed therein in accordance with the present invention.

FIG. 6A is a plan view of a unitary blank 12' used to form the container 10' shown in FIG. 5 in accordance with the preferred embodiment of the invention. The unitary blank 12' is similar to the unitary blank 12 except that a plurality of reinforcing locking tabs 112*a*, 112*b*, 112*c*, 112*d* and vent holes 110 are included in the preferred embodiment of the invention. In addition, two hook tabs 114*a*, 114*b* each of which extends from the respective lateral free edges of the bottom lid flap or top lid panel 26' and their corresponding slots 116*a*, 116*b* are formed on top lid panel 24' so that the respective hook tabs 114*a*, 114*b* are inserted into the respective slots 116*a*, 116*b* when the top lid panels 24' and 26' are in overlapped position to enclose the container 10'. The hook tabs 114*a*, 114*b* are not critical to the preferred embodiment of the invention and they are used only to further tightening or holding down the top lid panel 26' onto the container when the users unreasonably over-packed the container with heavy products such as frozen meat and/or canned goods and the like. The four reinforcing locking tabs 112*a*, 112*b*, 112*c*, 112*d* are formed in strategic positions within the container 10' to enhance the integrity of the locks on the container 10'. For example, two reinforcing locking tabs 112*a*, 112*b* are formed on the top lid panel 24' and the other two reinforcing locking tabs 112*c*, 112*d* are formed on the top lid panel 26'. The respective reinforcing locking tabs 112*a*, 112*b* are formed at longer edge on the border of the top lid panel 24' and side wall 16' and they are spaced apart from one another. Similarly, the respective reinforcing locking tabs 112*c*, 112*d* are formed at longer edge on border of the top wall 26' and side wall 18' and they are mirror image of the locking tabs 112*a*, 112*b*. Moreover, the respective reinforcing locking tabs 112*a*, 112*b*, 112*c*, 112*d* are formed adjacent to the respective locking tabs 46' and 48'. The features of the blank 12' that is the same as blank 12 in FIG. 2 will be described herein blew.

The top and bottom lid panels 24', 26' and side walls 16', 18' are arranged end-to-end in a series, with the bottom panel 14' in the center of the series. The top lid panel 24' includes cover latches 28' formed at each outer corner edge. Each cover latch 28' includes an arcuate outer edge shape 30'. First and second inner scores 32', 34' are provided to distinguish the cover latch from the top lid panel 24'. The second score line 34' is formed in the body of the latch 28', at a radial orientation. As shown, both the first score line 32' and the second score line 34' are angled outward for reasons are described below. Such angling is preferred but may be omitted for a particular arrangement. In the embodiment shown, the first and second scores are not oriented with the same angle where the first is more outwardly angled. The outermost edge 36' of the cover latch 28 is clipped inwardly to facilitate proper engagement with the cover latch slots.

Each of the side walls 16' and 18' further includes at least two locking tabs 46'. The locking tabs 46' are mushroom-shaped, with the base of the mushroom aligning with the hinge line between the respective side wall and its respective lid panel. The locking tab 46' includes a thumb notch 48' at the base of the mushroom shape, adjacent the hinge line.

The first and second end walls 20, 22 are formed similarly and they are mirror image of one another. Thus, for brevity, the first end wall will be described. The first end wall 20' is joined to the bottom panel 14' along hinge line or fold line 50'. The end wall has a first lateral edge defined by hinge line or fold line 52, and a second lateral edge defined by hinge line or fold line 54. The hinge lines 52' and 54' are located at both end of and transverse to the aforementioned bottom panel hinge line 50'. Each hinge line or fold line 52' and 54' joins a series of reinforcing panel sub-assemblies generally indicated at 56' and 58', respectively. Each end wall includes a hand hole lock 60 formed from an arcuate cut line 61 and first and second perforate lines 62, 63. Cover latch slots 64' are located above the hand hole lock 60' in the finished container. Each end wall 20, 22 also includes a recess 66 located along the end wall's exterior edge.

There are four reinforcing panel sub-assemblies which two of them foldably extend from the end wall 20' and the other two foldable extend from the end wall 22'. Since all of the four reinforcing panel sub-assemblies are the same, then only two of them are described hereinafter. The first reinforcing panel sub-assembly 56' includes a series of foldably connected inner, middle and outer panels 70', 72', and 74'. A severing line 76 divides the side wall 16' from the inner and middle panels 70', 72'. The severing line 76 also divides the top lid panel 24' from the outer panel 74' in a manner which forms the cover latch 28'. The bottom panel fold line 50' is slightly inwardly offset from the severing line 76, so as to facilitate the folding sequences described below.

The respective outer panel 74' includes an alignment recess 73' that sits around the hand hole 60 when the blank is fully constructed. The respective inner panel 70 includes a free edge having a pair of recesses 82' that are preferably formed with sharp 90 degree corners. Similarly, the free edge of the middle panel 72' includes a pair of recesses 78' that are preferably formed with sharp 90 degree corners. The material between the recesses forms a sharply-cornered intermediate tabs 84'. The pair of recesses 78' is laterally aligned with the pair of recesses 82' which provides leeway for engaging the locking tab 46'. The hinge line 90 joining the inner and middle panels is a perforated and scored line. The hinge line 92 joining the middle and outer panels is perforated. The hinge lines or fold lines 52', 90', and 92' of the first sub-assembly are essentially orthogonal to the bottom panel hinge line 50'.

The second reinforcing panel sub-assembly 58' also includes a series of hingedly connected inner, middle and outer panels 100', 102', 104'. As above, a severing line 106 divides the side wall 18 from the inner and middle panels 100, 102. This severing line 106' also divides the bottom lid panel 26' from the outer panel 104' in a manner which forms the respective hook tabs 114*a*, 114*b*. The respective hook tabs 114*a*, 114*b* is joined to the bottom lid panel 26'. As above, the bottom panel fold line 50 is slightly inwardly offset from the severing line 106', so as to facilitate folding. The panels of the second sub-assembly are similar to those of the first sub-assembly, except the outer panel 104' is cut to accommodate the hand hole 60 when the blank is fully constructed and does not include the cover latch 28'. Thus, as can be seen from studying FIG. 6A, the container blank is symmetrical about a longitudinal center line, but is not symmetrical about a transverse center line, e.g., the cover latches 28 are located at only the upper region of the blank in FIG. 2 and the hook tabs 114*a*, 114*b* are located at only the lower region.

FIG. 6B is a plan view of an alternative unitary blank 12" that is the same as blank 12' in FIG. 6A except that four extra locking tabs 48*a*, 48*b*, 48*c*, 48*d* and corresponding four recesses 78*a*, 78*b*, 78*c*, and 78*d* are formed therein in accordance with the present invention. The respective extra locking tabs 48*a*, 48*b*, 48*c*, and 48*d* are formed in proximity of the respective locking tabs 48" in spaced relationship. The corresponding four recesses 78*a*, 78*b*, 78*c*, and 78*d* are formed in proximity of the respective recesses 82" and 66" in spaced relationship. The extra locking tabs 48*a*, 48*b*, 48*c*, and 48*d* are formed to provide exceedingly strength to prevent any failure of the container 10 during shipping when some users unreasonably over-packed the container 10 with heavy products. When the container 10 is fully constructed from the blank 12", the extra locking tabs 48*a*, 48*b*, 48*c*, and 48*d* are engaged with the corresponding four recesses 78*a*, 78*b*, 78*c*, and 78*d* in the same manner as the locking tabs 48" being engaged with their corresponding recesses 78", 82", and 66".

Figure 7A:
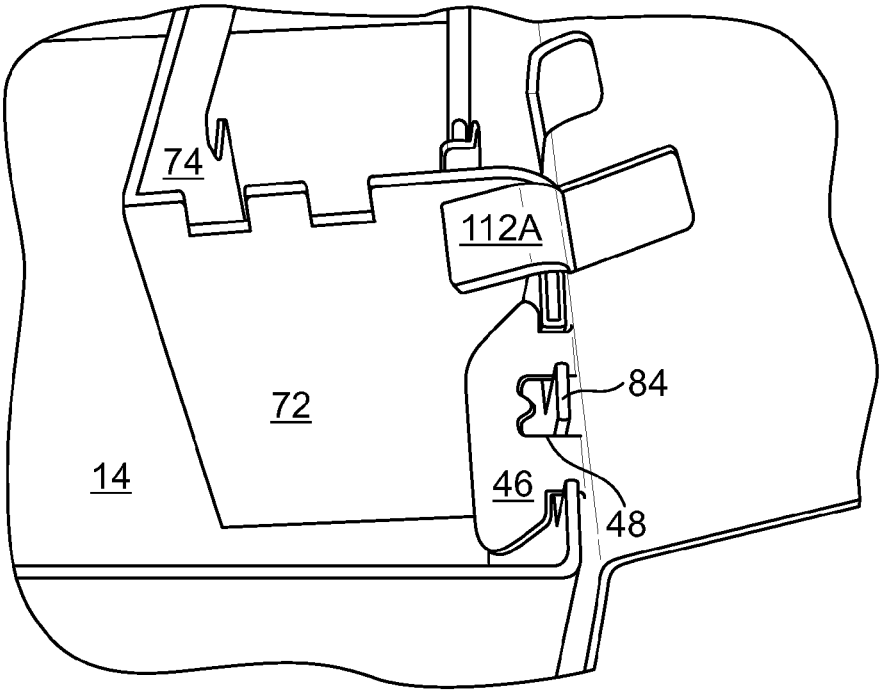
FIG. 7A illustrates the unitary blank of FIG. 6A in a partially folded position by illustrating one of the two reinforcing locking tab formed into the side wall of the container depicted in FIG. 5.
Figure 7B:
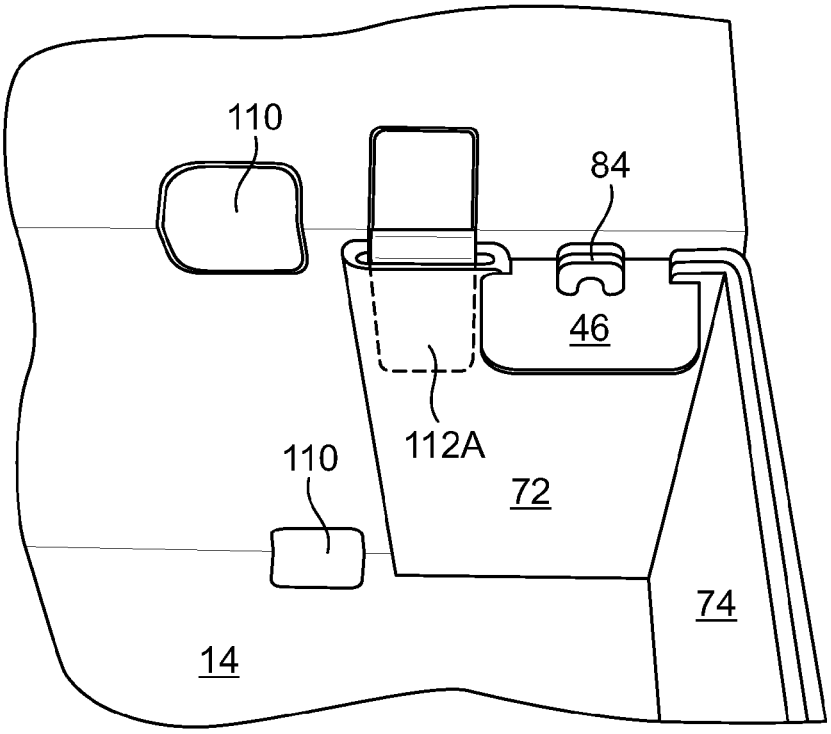
FIG. 7B is similar to FIG. 7A, which illustrates the reinforcing locking tab in fully folded position.

The manual set-up of the blank 12' to form the container 10' is easily accomplished. Starting from a horizontally-oriented blank 12', each reinforcing panel sub-assembly 56', 58' is folded upward, out of the plane of the blank along hinge or fold lines 52 and 54. The sub-assembly middle panel 72' is folded inward approximately 180 degrees from the inner panel 70', while simultaneously folding the outer panel 74 upward 90 degrees from the middle panel 72. The end result is a doubling-over of the inner and middle panels 70', 72' onto the side wall 16 and the outer panel 74' onto the end wall 20', respectively as seen best in FIGS. 7A and 7B. After both reinforcing panel sub-assemblies have been formed, the combined sub-assembly and the side walls 16', 18' and the end walls 20', 22' are in partially folding position, the respective locking tabs 112*a*', 112*b*', 112*c*', and 112*d*' are pushed toward the interior of the container 10' as depicted in FIG. 7A. Next, each respective reinforcing locking tabs 112*a*, 112*b*', 112*c*, and 112*d* is sandwiched between their respective inner panels and middle panels. For example, as illustrated in FIGS. 7A & 7B, the reinforcing locking tabs 112*a* is sandwiched between the inner panel 70' and middle panel 72' and then the outer panel 74' overlapped onto the end wall 20'. Similarly, the reinforcing locking tabs 112*b* is sandwiched between the inner panel 100' and middle panel 102' and then the outer panel 104' overlapped onto the end wall 20'. As noted previously, the blank 12' is symmetric with respect to the longitudinal axis thereof and therefore the both sides of the blank 12' are mirror image of one another. The respective reinforcing locking tabs 112*a*, 112*b*, 112*c*, and 112*d* prevents the side walls to be distorted when outward pressure is applied to these side walls during transportation.

In sum, the purpose of present invention is to reduce the propensity of the previously existing length-panel locks on the container 10' from opening when outward pressure was applied at the side walls or when the lid of the container was folded away from the container when the container is filled with heavy products. The existing locks 46' on the container may be opened if it is over packed, and thus the container would lose its shape, and essentially return to a knocked-down flat shape. Four reinforcing locking tabs 112*a*, 112*b*, 112*c*, and 112*d* are added that would prevent the side walls 16', 18' from being deflected outward, thus reducing the propensity of the side wall locks from opening. When these reinforcing locking tabs are in-place, the side walls of the container are held in a vertical position, thus maintaining the integrity of the locks on the container. Furthermore, these reinforcing locking tabs 112*a*, 112*b*, 112*c*, and 112*d* also reduce length-panel bulge when the carton is under load. Additionally, these reinforcing locking tabs are formed by material which is already contained in the existing blank size of the container. No additional material or increase in blank size or in the basis weight of corrugated material is added to container to gain the benefits which the present invention provides.

While the preferred embodiment of the invention has been illustrated and described, it will be appreciated that various changes can be made therein without departing from the spirit and scope of the invention. In particular, the drawings and the foregoing descriptions are not intended to represent the only forms of the invention in regard to the details of its construction and manner of operation. Indeed, the inventive aspects taught by the present invention may be practiced alone or in combination. Further, as will be appreciated by those skilled in the art, various modifications are possible in how the various fold lines, etc. are formed. For example, perforations may be used in some instances, while crushes or even cuts are used in others.

What is claimed is:

1. A container formed from a one-piece blank having a bottom panel, first and second opposed side walls foldably attached to the bottom wall, and first and second end walls foldably attached to the bottom wall, a top lid panel foldably attached to the first side wall and a bottom lid panel foldably attached to the second side wall, each of the respective first and second end walls includes a respective first and second reinforcing panel sub-assembly foldably attached thereto wherein the respective first and second reinforcing panel sub-assembly being defined by an inner panel, a middle panel, and an outer panel, eight locking tabs in which four of the eight locking tabs (46, 46), (48*a*), (46*b*) are formed on the first side wall and the other four of the eight locking tabs (46, 46), (48*c*), (48*d*) are formed on the second side wall, four reinforcing locking tabs two of which being formed in the top lid panel and two of which being formed in the bottom lid panel wherein each of the four reinforcing locking tabs is sandwiched between one of the inner panels and one of the middle panels to prevent the side walls from being distorted upon outward pressure applied to these side walls when the container is unreasonably over-packed during shipping and transportation.

2. A container formed from a one-piece blank, comprising:

a bottom panel having two pairs of opposed side edges;

first and second opposed side walls hingedly connected to one of the two pair of opposed side edges of the bottom panel;

a top lid panel hingedly connected to the first side wall, the top lid panel includes two reinforcing locking tabs (112*a*), (112*b*) spaced apart from one another, a locking tab formed in the first side wall on the hinged connection, the locking tab including a thumb notch located within the tab adjacent to the hinged connection; the top lid panel including a pair of cover latches located on the outer corners thereof;

a bottom lid panel hingedly connected to the second side wall, the bottom lid panel including a pair of alignment tabs located on the outer corners thereof;

first and second opposed end walls hingedly connected to the other pair of opposed edges of the bottom panel; each end wall having opposed side edges oriented orthogonal to its hinged connection to the bottom panel; each end wall including a hand hole lock, a lock slot, and a recess located along an end wall exterior edge; the lock slot being located between the recess and the hand hole lock; each end wall further including:

a first reinforcing panel sub-assembly hingedly connected to one end wall edge and including an inner panel, a middle panel, and an outer panel; the outer panel including a recess along an outer panel exterior edge and a hand hole; the middle panel including a locking slot near a middle panel exterior edge; the inner panel including a pair of recesses with an intermediate tab located along an inner panel exterior edge; and a second reinforcing panel sub-assembly hingedly connected to the other end wall edge and including an inner panel, a middle panel, and an outer panel; the middle panel including a locking slot near a middle panel exterior edge; the inner panel including a pair of recesses and an intermediate tab each located along an inner panel exterior edge; wherein as assembled, the locking tab is disposed within the lock slot with the intermediate tab of the inner panel inserted into the locking tab thumb notch; the cover latch is inserted into the locking slot of the end panel; and the alignment tabs are positioned in the recesses of the outer panel of the first reinforcing panel sub-assembly and the end wall; and each of the respective reinforcing locking tabs (112*a*), (112*b*), (112*c*), (112*d*) is sandwiched between one of the inner panels and one of the middle panels to prevent the side walls from being distorted upon outward pressure applied to these side walls when the container is unreasonably over-packed during shipping and transportation.

* * * * *